United States Patent [19]

Knitter

[11] Patent Number: 4,936,453

[45] Date of Patent: Jun. 26, 1990

[54] COMPACT FLUORESCENT TUBE DUNNAGE ELEMENT

[75] Inventor: Joseph A. Knitter, Lawrence, Kans.

[73] Assignee: The Lawrence Paper Company, Lawrence, Kans.

[21] Appl. No.: 396,562

[22] Filed: Aug. 21, 1989

[51] Int. Cl.[5] ..... B65D 85/42

[52] U.S. Cl. ..... 206/419; 206/443; 206/585; 206/587; 206/593

[58] Field of Search ..... 206/418, 419, 420, 443, 206/585, 587, 591, 592, 593, 594

[56] References Cited

U.S. PATENT DOCUMENTS

| | | | |
|---|---|---|---|
| 2,568,769 | 9/1951 | Shepard | 206/419 |
| 2,838,173 | 6/1958 | Emery | 206/419 |
| 3,708,084 | 1/1973 | Bixler et al. | 206/419 X |
| 4,427,730 | 1/1984 | Robbins et al. | 206/419 X |
| 4,705,170 | 11/1987 | Creaden | 206/419 |
| 4,792,045 | 12/1988 | Creaden | 206/419 |

*Primary Examiner*—William Price

*Attorney, Agent, or Firm*—Hovey, Williams, Timmons & Collins

[57] ABSTRACT

An improved synthetic resin support for fluorescent tubes is provided which uses a minimum of synthetic resin material in the manufacture thereof, while at the same time giving entirely adequate support and protection against breakage of packed fluorescent tubes. The supports of the invention are in the form of an integral preformed synthetic resin body presenting a plurality of elongated, fore and aft extending, open-top tube-receiving concave regions together with top wall sections between the respective tube-receiving concavities formed in a sawtooth configuration to provide additional support against crushing and tube breakage. The preferred supports in accordance with the invention are also provided with specially configured upwardly and downwardly diverging, alternating wall sections along the length of the concavities thereof for simultaneous supporting upper and lower fluorescent tubes within a carton. Stacking lugs are provided with the supports so as to facilitate formation of machine-dispensable stacks of the supports so that automated processing with the supports of the invention is facilitated.

7 Claims, 3 Drawing Sheets

6.
6.
A
B
C

COMPACT FLUORESCENT TUBE DUNNAGE ELEMENT

BACKGROUND OF THE INVENTION

1. Field of the Invention

The present invention is broadly concerned with an improved synthetic resin fluorescent tube support adapted to be used in the packaging and shipping of elongated fluorescent tubes in order to prevent breakage thereof. More particularly, it is concerned with such a fluorescent tube support which is improved by provision of specific structural features allowing significant reductions in the use of synthetic resin sheet material for the support, while giving equivalent protection against breakage, as compared with synthetic resin supports described in the prior art.

2. Description of the Prior Art

U.S. Pat. Nos. 4,705,170 and 4,792,045 describe fluorescent tube dunnage supports formed of integral, synthetic resin sheet material and which are designed to supplant traditional supports manufactured from pulp or the like. A prime advantage of the supports described in the aforementioned patents stems from the fact that they are machine dispensable, i.e., they overcome the problems heretofore associated with attempts at machine dispensing fluorescent tube supports, thereby lowering manufacturing costs.

The tube supports described in these patents represent a substantial breakthrough in the art, and have achieved substantial commercial success. However, recent marked increases in the cost of preferred synthetic resin material (e.g., polyvinylchloride) have led to attempts to fabricate the supports using smaller quantities of synthetic resin. The straightforward approach of simply shortening the fore and aft length thereof have proved unsuccessful though, inasmuch as such modified supports simply do not provide the degree of breakage protection demanded by fluorescent tube manufacturers. Accordingly, the problem of providing a synthetic resin tube support meeting the twin goals of minimal use of starting sheet material while at the same time giving proper tube support, has proved considerably more difficult than originally thought.

It would therefore be a significant improvement to provide a tube support of integral, synthetic resin construction which retains the advantages described in U.S. Pat. Nos. 4,705,170 and 4,792,045, while at the same time making use of lesser quantities of synthetic resin starting material.

SUMMARY OF THE INVENTION

The present invention overcomes the problems noted above, and provides an improved dunnage support having specific constructional features allowing it to provide altogether satisfactory protection for fluorescent tubes during packaging and transit, while at the same time materially reducing the amount of starting material required in the production of the support. In practice, tube supports in accordance with the invention can be manufactured using something on the order of 40% less starting synthetic resin sheet material than heretofore required; furthermore, this is accomplished without sacrifice of the principal necessary property of the supports, i.e., providing adequate protection against tube breakage.

Broadly speaking, tube supports in accordance with the invention are in the form of integral synthetic resin bodies presenting concavo-convex walls defining a number of elongated, open-top, juxtaposed concave tube-receiving regions, with elongated, axially extending top walls between such adjacent tube-receiving regions. Furthermore, the preferred supports include, along the length of the respective tube-receiving regions, a first plurality of axially spaced apart, upwardly opening and diverging tube-engaging wall sections, together with a second plurality of axially spaced apart, downwardly opening and diverging tube-engaging arcuate second wall sections which alternate with the first wall sections. Upstanding walls are provided between and in interconnecting relationship with the alternating first and second wall sections.

The specific improvements of the present invention, designed to minimize material usage while at the same time giving adequate tube protection, include specialized top walls between the respective tube-receiving sections. In U.S. Pat. No. 4,705,170 (which is incorporated by reference herein), such wall sections 26 were simply planer segments. It has been found, however, that tube protection can be enhanced by providing such interconnecting wall sections with a sawtooth-type configuration. In particular, the interconnecting wall sections between the tube-receiving regions include a plurality of upwardly extending projections along the length thereof, with such projections being defined by a pair of inclined, converging, upwardly extending sidewalls, and an elongated peak region at the joinder of the sidewalls. These peak regions extend transversely relative to the longitudinal axes of the tube-receiving concavities forming a part of the support.

In another aspect of the invention, the downwardly diverging second wall sections of the tube-receiving regions lie fully below the plane defined by the normal bottom margin of the support. Stated otherwise, the front, rear and end walls of the supports of the invention lie in a common plane; and the entirety of the downwardly opening tube-engaging second wall sections forming a part of the concavo-convex walls of the tube-receiving regions lie below this plane. This is in contrast to the support as described in the above referenced patent, wherein only the extreme tips of the downwardly opening wall sections extended below the bottom plane of the support.

Finally, the tube supports described in the aforementioned patent included upstanding wall sections 62 interconnecting the alternating upwardly and downwardly opening wall section forming a part of the concavo-convex walls 22 thereof. In the tube support of the present invention, however, it has been found that enhanced tube protection results when these interconnecting wall sections are oriented at a substantial oblique angle, with the pair of connecting wall portions extending from each downwardly opening wall section diverging from one another. In this fashion, and in accordance with the preferred aspects of the invention, the upwardly opening first wall sections are of substantially less width than the alternating downwardly opening sections, with all such widths being measured in a direction parallel with the longitudinal axes of the tube-receiving regions.

DESCRIPTION OF THE PREFERRED EMBODIMENTS

Figures 1, 2, 3, 4, 5:
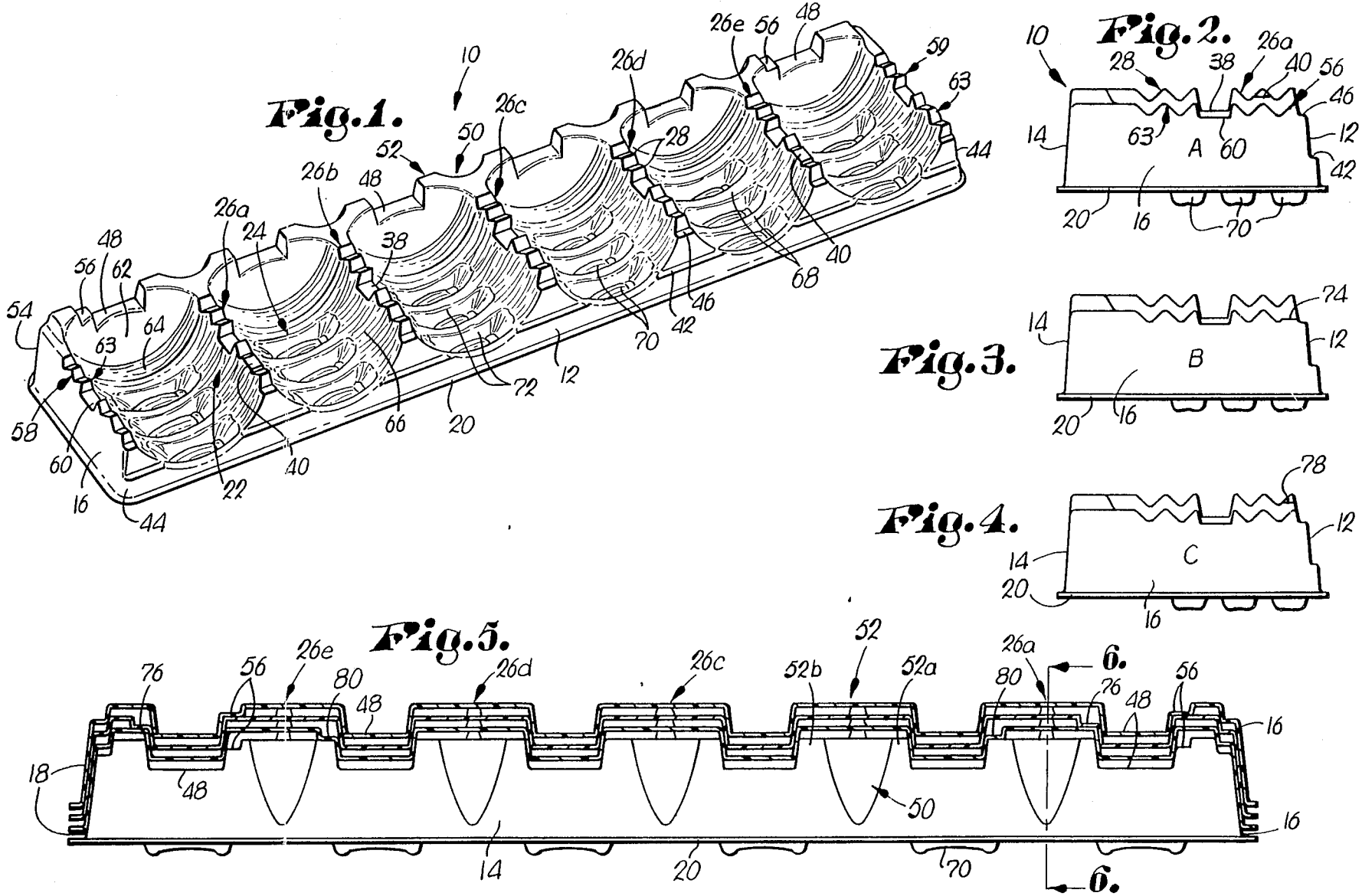
FIG. 1 is a perspective view of one form of a tube support in accordance with the present invention, illustrating a stacking lug configuration referred to herein as "Configuration A"
FIG. 2 is an end elevational view of the support depicted in FIG. 1.
FIG. 3 is an end elevational view similar to that of FIG. 2, but illustrating a form of the tube support having a stacking lug configuration referred to herein as "Configuration B"
FIG. 4 is a view similar to that of FIGS. 2 and 3, but illustrating another form of the invention, wherein the stacking lug configuration is preferred to as "Configuration C"
FIG. 5 is a vertical sectional view of a stack of supports in accordance with the invention, illustrating the interfitting of the stacking lug configurations A, B and C, and further showing the details of the support.

Turning now to the drawings, in particulary FIG. 1, a tube support 10 in accordance with the invention is depicted. The support 10 is in the form of an integral, synthetic resin, thermo-formed body presenting a rear wall 12, front wall 14, and interconnecting end walls 16, 18. The walls 12-18 include, at the lowermost extents thereof, a common, circumscribing, short, laterally extending peripheral lip 20.

The overall support 10 is further provided with a total of six concavo-convex wall sections 22 which cooperatively present a plurality of individual, elongated, open-top, parallel, juxtaposed concave tube-receiving sockets or regions 24. It will be noted in this respect that the regions 24 terminate at rear wall 12, and accordingly the latter presents in overall configuration a scalloped appearance. The wall sections 22 are joined at their respective apices by means of elongated, fore and aft extending connector walls 26 of specialized configuration. In particular, the embodiment of FIG. 1 includes connector walls 26*a*–26*e*, of which walls 26*a* and 26*e* are identical, whereas walls 26*b*, 26*c* and 26*d* are identical. In each case, however, the walls 26*a*–26*e* are of sawtooth-like configuration and include a plurality of upwardly extending projections 28 along the length thereof (see FIG. 6). Each projection 28 is in turn defined by a pair of upwardly converging and inclined sections 30, 32 together with a transversely extending peak region 34. As will further be observed from a study of FIG. 6, corresponding valley regions 36 are also provided between adjacent peak regions. In the case of wall sections 26*b*, 26*c* and 26*d*, each includes a generally retangular recess 38 with a total of three peak regions 34 extending forwardly therefrom, and a total of three peak regions extending rearwardly therefrom. The top walls 26*a* and 26*e* are identical with the walls 26*b*–26*d*, save for the fact that a flattened stacking lug 40 is provided in the rearwardly extending portion of the wall between the recess 38 and rear wall 12. The importance of this stacking lug arrangement will be made clear hereinafter.

The rear wall 12 is an upstanding member which is slightly inclined as best seen in FIGS. 1 and 2, and includes a transversely extending ledge 42 above lip 20. The rear wall 12 merges with the end walls 16, 18, at rounded corners 44. Finally, it will be seen that a secondary ledge 46 extends transversely across the face of rear wall 12 above the lower ledge 42, so as to give the face of sidewall 12 a stepped configuration.

The front wall 14 is an upright member having a total of six laterally spaced apart, generally horizontal pin-receiving recesses 48 formed therein, with each of the latter being in alignment and in communication with a corresponding, rearwardly extending, tube-receiving region 24. In addition, the face of front wall 14 is provided with a total of six arcuate, upwardly opening indentations 50 which are oriented in alternating relationship with the recesses 48. Each indentation 50 is in effect defined by a somewhat Y-shaped wall section 52 formed by a pair of bifurcations 52*a*, 52*b* (see FIG. 5). The front wall 14 is merged into end walls 16, 18 at rounded corners 54. In addition, in the FIG. 1 embodiment, the front wall 14 is provided with a pair of planer stacking lugs 56 adjacent the endmost recesses 48 (see FIG. 1). Here again, the function of the stacking lugs will be explained hereinafter.

The end walls 16, 18 are essentially identical and each is a substantially planer, upright member terminating in an upper wall section presenting a top wall section 58, 59 which merges with and assists in defining the adjacent end board tube-receiving region 24. In this connection, the top wall sections 58, 59 are configured much in the manner of the intermediate top wall sections 26*a*–26*e*, and include a central, substantially rectangular recess 60 as well as structure defining the upstanding, fore and aft extending projections 62 which are identical in all respects to the corresponding projections 28 described above.

Each of the tube-receiving regions 24 is defined by an upstanding somewhat inclined and tapered inner wall portion 62 which is generally parallel with front wall 14, as well as an arcuate, diverging, upwardly opening wall segment 64 adapted to receive the metallic endcap of a fluorescent tube. The portion of concavo-convex wall portion 22 extending rearwardly from the wall segment 64 includes, in the case of each region 24, a major wall 66 of arcuate, upwardly opening and diverging configuration adapted to receive the arcuate sidewall of a fluorescent tube. In each instance the major wall 66 merges into a corresponding pair of top walls arranged on either side of the recess 24.

Figure 6:
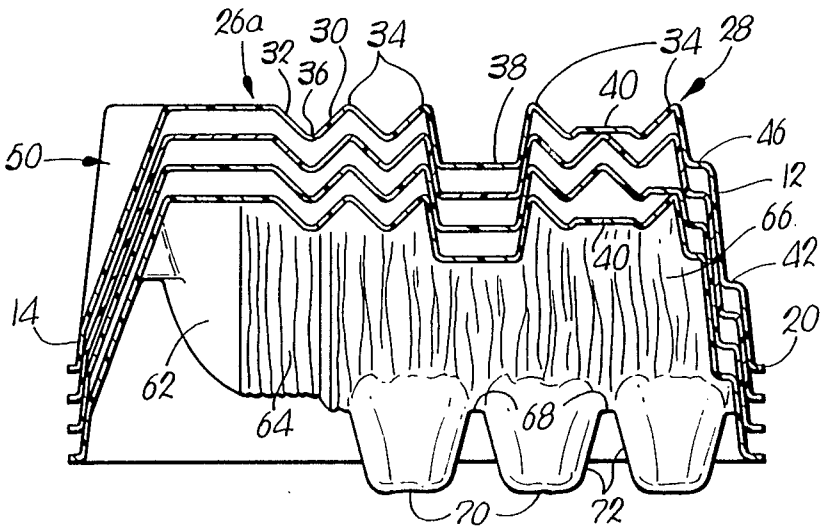
FIG. 6 is an enlarged sectional view taken along the lines 6—6 of FIG. 5.

The major wall 66 further includes a first plurality (here 3) of arcuate, upwardly opening and diverging first wall sections 68 which are formed to generally conform with the curvature of a fluorescent tube, together with a second plurality of downwardly opening end diverging arcuate second wall sections 70 which are likewise configured to engage the sidewall of a flurorescent tube. As best seen in FIG. 6, the walls 68, 70 alternate along the length of major wall portion 66. Further, it will be seen that the alternating wall sections 68, 70 are interconnected by means of upstanding, inclined connector walls 72. In particular, each of the second wall sections 70 has, at its fore and aft margins, an upstanding connector wall 72 oriented such that the pair of walls 72 diverge upwardly and merge into an associated adjacent wall section 68. This inclination of the sidewall 72 has been found to be important in practice in that proper material distribution during molding is effected by such inclination. Indeed the inclination thereof should be at least 10° with respect to the vertical. It will further be seen that the width of the respective first wall sections 68 are considerably less than the widths of the second wall sections 70. It has been found that adequate protection for a tube within the region 24 defined by major wall 66 and its associated structure is offered by means of the short wall section 68; on the other hand, adequate protection is provided for an underlying fluorescent tube which engages the second wall section 70.

Figure 7:
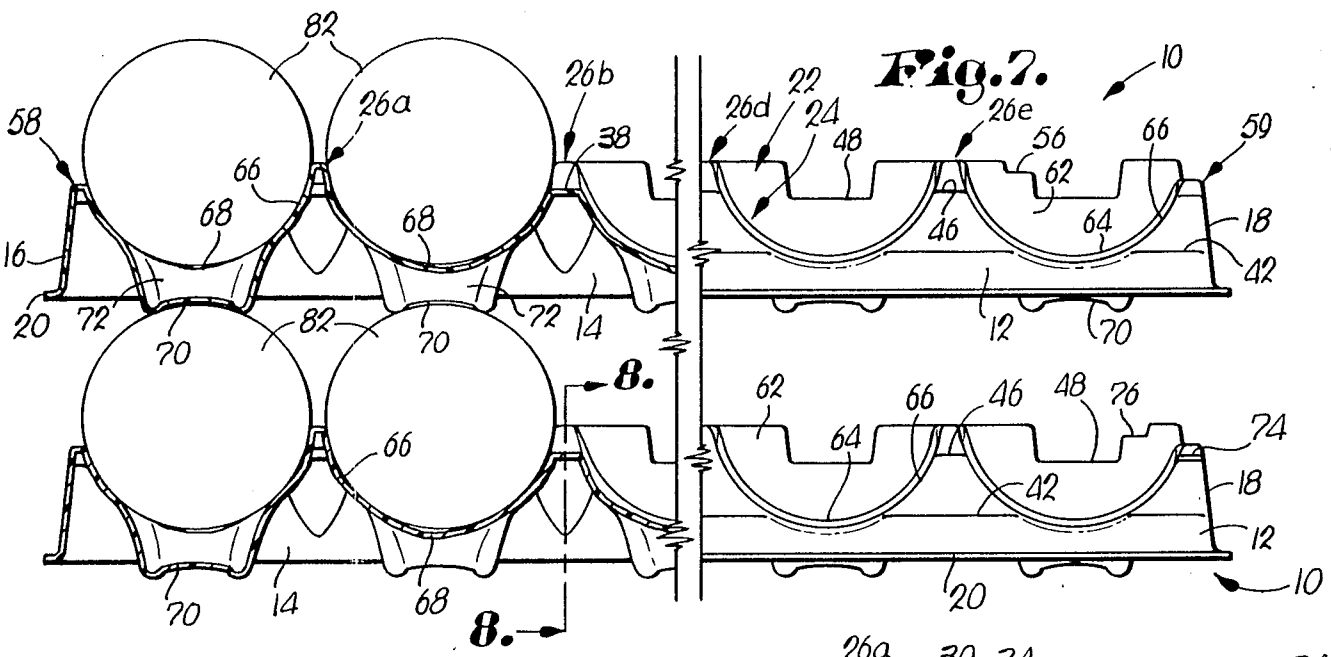
FIG. 7 is a fragmentary view partially in elevation and partially in section of a pair of tube supports in accordance with the invention, shown operatively supporting and protecting fluorescent tubes.
Figure 8:
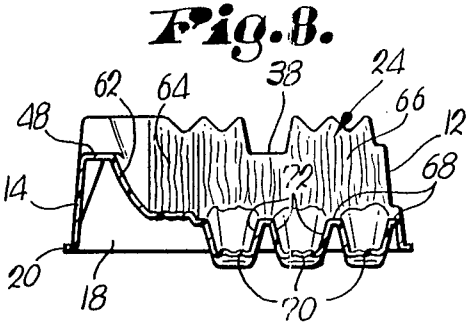
FIG. 8 is a vertical sectional view taken along the line of 8—8 of FIG. 7.

Finally, it will be seen that the second wall section 70 extend a substantial distance below the lower margin of the associated support defined by the lip 20. As best seen in FIGS. 5 and 7, the wall sections 70 are located at a point below the lip 20 such that the entire arcuate extent of the wall is below the lip. This is in sharp contrast to the construction shown in U.S. Pat. No. 4,705,170, where only the outermost ends or tips of the downwardly opening wall sections extended below the lower margin of the support. Here again, this construction of the present invention has been found to give increased protection for fluorescent tubes.

As described previously, it is desirable to form the supports of the present invention in a series of closely similar yet different parts, so as to facilitate stacking thereof. In the exemplary embodiment shown herein, the overall support is formed into three separate stacking configurations, namely configurations A, B and C, which are respectively illustrated in FIGS. 2–4. In the FIG. 2 embodiment, stacking lugs 40 and 56 are provided, whereas in configuration B lugs 74, 76 are formed into the support. Finally, in configuration C, lugs 78, 80 are provided. These lugs can be viewed and understood from a consideration of FIGS. 1–5. In any event, those skilled in the art will appreciate that the lugs are appropriately offset in the respective configurations so as to facilitate stacking of the supports in a machine dispensable stack wherein at least a $\frac{1}{8}$ inch (and preferably from about $\frac{1}{8}$ to $\frac{3}{8}$ inch) spacing is provided between each individual support in stack. In this fashion, the automated dispensing equipment can readily separate the respective supports 10 without fear of machine foul-ups. Those skilled in the art will appreciate that many other stacking lug configurations can be employed with the supports of the invention, other than those herein specifically disclosed.

The use of supports 10 is best illustrated in FIG. 7, where it will be seen that a pair of supports 10 are placed in superposed relationship to one another, with fluorescent tubes 82 seated in the tube-receiving regions thereof. In this connection, it will be seen that the defining walls of each region 24 cradle and receive a corresponding tube 82, whereas the downwardly opening end diverging second wall section 70 of each region 24 contact and support a fluorescent tube immediately therebelow. In this fashion, it will be perceived that a stack of tubes and supports can be constructed for insertion into a paper carton, to thus protect the tubes during packaging and transport.

The elements 10 may be formed of a wide variety of synthetic resin materials such as polyvinylcholorides, polyesters or polyethylene terphthalates. In the most preferred forms however, the supports are formed from PVC material having a thickness of from about 0.009–0.018 inches, more preferably about 0.013–0.018 inches, and most preferably about 0.013–0.014 inches. In addition, while a variety of molding techniques can be employed, it is presently preferred to make use of a male mold for forming the supports 10, with a water cooled plug assist. In this fashion, the thickness of the various regions of the integral support can be varied at will, with the wall sections 26 and 58, 59 normally being thickest, but with substantial material being deposited along the oblique walls 72 and the alternating first and second wall section 68, 70. Of course, many variations on this mode of manufacture and the resultant differential wall thicknesses will occur to those skilled in the art.

Figure 9:
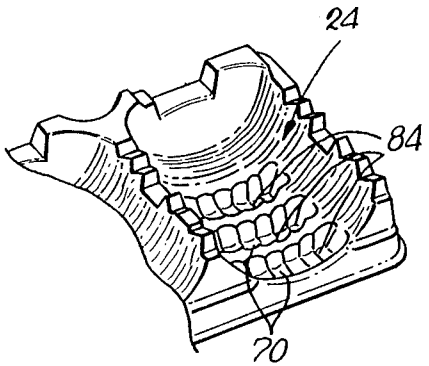
FIG. 9 is an enlarged fragmentary perspective view illustrating the optional use of fluting on the downwardly diverging second wall sections forming a part of the concavo-convex tube-receiving walls.

FIG. 9 illustrates yet another embodiment in accordance with the invention, wherein fore and aft extending side-by-side flutes 84 are provided in the second wall sections 70. This alternative is also believed to enhance the strength of the resultant support, in terms of preventing unwanted breakage of fluorescent tubes.

Attention is next directed to FIGS. 10–13, illustrating another embodiment of the invention. In this instance, a tube support 86 is provided which is in many respects similar to the supports previously described. Thus, the support is formed of synthetic resin material and is in the form of an integral, thermal-formed body presenting a rear wall 88, front wall 90 and a pair of fore and aft extending sidewalls 92, 94. The support further includes a total of six concavo-convex wall sections 96 which cooperatively present individual, elongated, open-topped parallel, juxtaposed, concave tube-receiving sockets or regions 98. In order to facilitate a description of this embodiment, the specific differences between the same and the embodiment of FIG. 1 will be detailed; other aspects of the FIGS. 10–13 embodiment are as illustrated essentially duplicative of the FIG. 1 embodiment.

Figure 10:
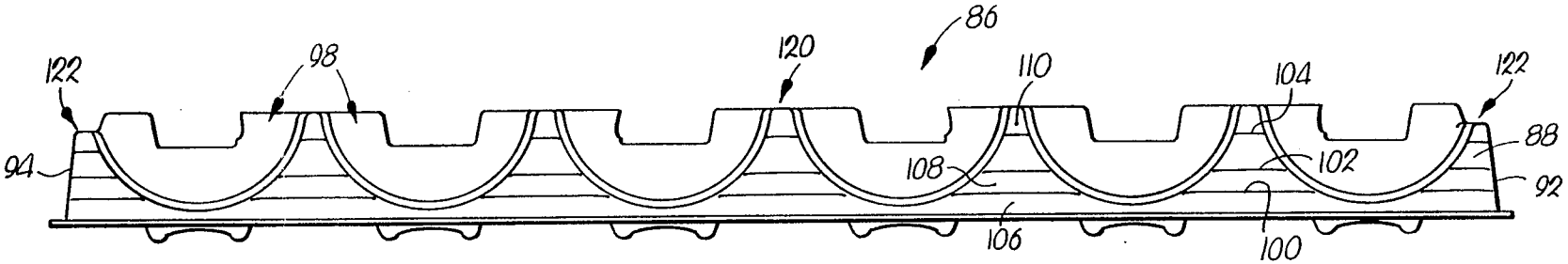
FIG. 10 is a rear elevational view of another embodiment of the invention.
Figure 13:
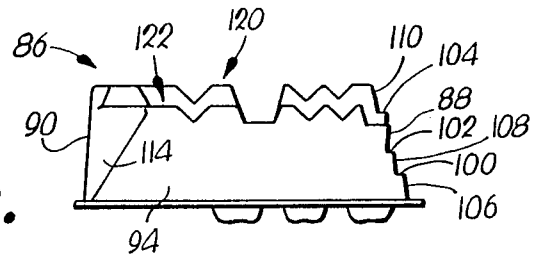
FIG. 13 is an end elevational view of the embodiment of FIGS. 10–12.
Figure 11:
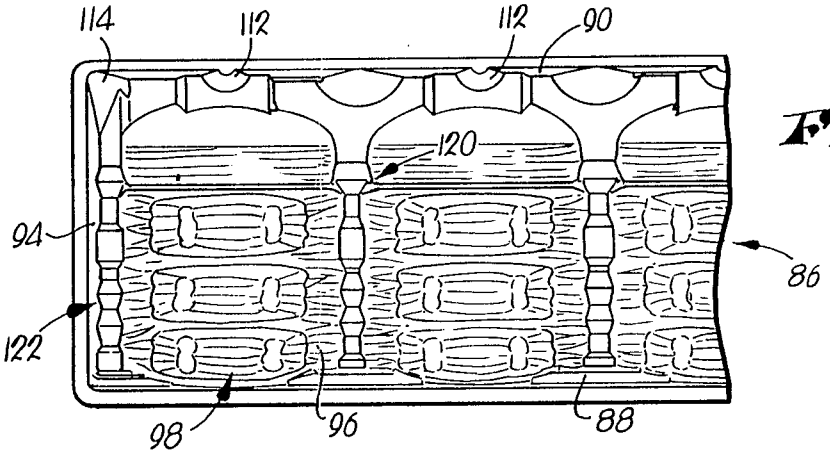
FIG. 11 is a fragmentary plan view of the embodiment depicted in FIG. 10.
Figure 12:
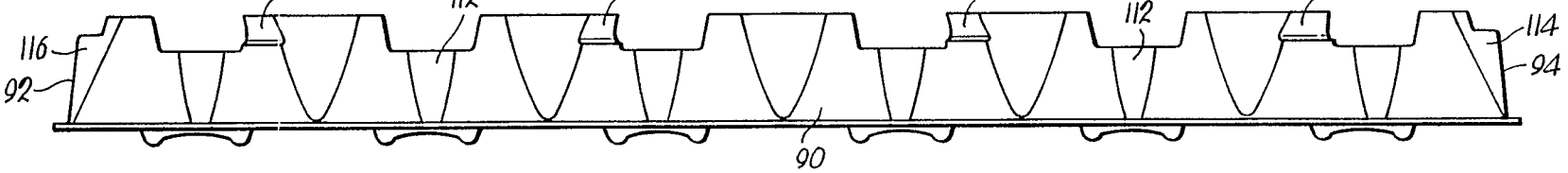
FIG. 12 is a front elevational view of the embodiment of FIGS. 10–11.

Turning first to FIG. 10, it will be noted that rear wall 88 presents a stepped configuration by provision of three laterally extending, vertically spaced apart ledge regions 100, 102 and 104, with corresponding upright regions 106, 108 and 110.

Front wall 90 on the other hand differs from the front wall of FIG. 1 by provision of secondary indentations 112 respectively in alignment with each of the pin-receiving recesses provided in the front wall. It will also be seen (FIG. 12) that the corners 114, 116 between the sidewalls 92, 94 and front wall 90 are beveled. Finally, front wall 90 includes a total of four stacking recesses 118 which cooperate with corresponding lugs (not shown) provided with mated, stackable supports.

The fore and aft extending top walls 120 between adjacent pairs of tube-receiving recesses, and the terminal top walls 122 at the respective ends of the support 86, are essentially the same in configuration as the corresponding top walls illustrated in the FIG. 1 embodiment, and are designed for the same purpose.

Likewise, the tube-engaging, oppositely upwarding and downwardly diverging wall segments forming the tube-receiving regions are essentially identical to those described, it being noted that these wall sections are also provided with shock-absorbing striations formed thereon.

I claim

1. In a fluorescent tube support formed of synthetic resin material and presenting an integral body having concavo-convex walls defining a number of elongated, open-top, parallel, juxtaposed concave tube-receiving regions with elongated, axially extending top walls between adjacent tube-receiving regions, the improvement which comprises structure defining a plurality of upwardly extending projections along the length of at least certain said top walls, said projections being defined by a pair of inclined, converging, upwardly extending sidewalls and an elongated peak region at the joinder of said sidewalls, said peak regions extending transverse to the longitudinal axes of said tube-receiving regions.

2. The support of claim 1, including a valley region at the joinder of adjacent, upwardly extending, diverging sidewalls forming a part of adjacent projections, said valley regions being substantially parallel with said peak regions.

3. The support of claim 2, said sidewalls, peak regions and valley regions presenting a sawtooth configuration along at least a part of the length of said top walls.

4. In a fluorescent tube support formed of synthetic resin material and presenting an integral body having concavo-convex walls defining a number of elongated, open-top, parallel, juxtaposed, concave tube-receiving regions, said region-defining walls including a first plurality of axially spaced apart, upwardly opening and diverging tube-engaging arcuate first wall sections, a second plurality of axially spaced apart, downwardly opening and diverging tube-engaging arcuate second wall sections alternating with said first wall sections, and connecting walls extending between and interconnecting said alternating first and second wall sections, the improvement which comprises said connecting walls each being obliquely oriented with the pair of connecting walls extending from each second wall section diverging from each other.

5. The support of claim 4, the width of said first wall sections being less than the width of said second wall sections, said widths being measured in a direction parallel with the longitudinal axes of said tube-receiving regions.

6. In a fluorescent tube support formed of synthetic resin material and presenting an integral body having concavo-convex walls defining a number of elongated, open-top, parallel, juxtaposed, concave tube-receiving regions, said region-defining walls including a first plurality of axially spaced apart, upwardly opening and diverging tube-engaging arcuate first wall sections, a second plurality of axially spaced apart, downwardly opening and diverging tube-engaging arcuate second wall sections alternating with said first wall sections, and connecting walls extending between and interconnecting said alternating first and second wall sections, the improvement which comprises said first wall sections having a width less than the width of said second wall sections, said widths being measured in a direction parallel with the longitudinal axes of said tube-recieving regions.

7. In a fluorescent tube support formed of synthetic resin material and presenting an integral body having concavo-convex walls defining a number of elongated, open-top, parallel, juxtaposed, concave tube-receiving regions, said region-defining walls including a first plurality of axially spaced apart, upwardly opening and diverging tube-engaging arcuate first wall sections, a second plurality of axially spaced apart, downwardly opening and diverging tube-engaging arcuate second wall sections alternating with said first wall sections, and connecting walls extending between and interconnecting said alternating first and second wall sections, the improvement which comprises said body having a circumscribing, downwardly extending skirt whose lower edge lies in a substantially common plane, the entirety of said arcuate second wall sections lying below said plane.

* * * * *